US007226140B2

(12) United States Patent
Matsui

(10) Patent No.: US 7,226,140 B2
(45) Date of Patent: Jun. 5, 2007

(54) ADJUSTING APPARATUS FOR ADJUSTING INCLINATION OF RECORDING HEAD OF INKJET PRINTER

(75) Inventor: Yasuhiro Matsui, Hachioji (JP)

(73) Assignee: Konica Minolta Holdings, Inc. (JP)

( * ) Notice: Subject to any disclaimer, the term of this patent is extended or adjusted under 35 U.S.C. 154(b) by 291 days.

(21) Appl. No.: 10/934,180

(22) Filed: Sep. 3, 2004

(65) Prior Publication Data

US 2005/0052495 A1 Mar. 10, 2005

(30) Foreign Application Priority Data

Sep. 9, 2003 (JP) ..... 2003-316603

(51) Int. Cl.
*B41J 25/308* (2006.01)

(52) U.S. Cl. ..... 347/8; 400/59

(58) Field of Classification Search ..... 347/8, 347/85, 86; 400/55, 59, 60
See application file for complete search history.

(56) References Cited

U.S. PATENT DOCUMENTS 6,089,696 A * 7/2000 Lubinsky ..... 347/40
6,575,557 B2 * 6/2003 Tominaga ..... 347/37
6,834,925 B2 * 12/2004 Ikeda ..... 347/8
6,981,755 B2 * 1/2006 Lim ..... 347/20

FOREIGN PATENT DOCUMENTS

JP 5-48194 7/1993

* cited by examiner

*Primary Examiner*—Stephen Meier
*Assistant Examiner*—J S U
(74) *Attorney, Agent, or Firm*—Cantor Colburn LLP

(57) ABSTRACT

There is provided an ink-jet printer for forming an image in a main scanning direction for each line. The ink-jet printer comprises a recording head to form an image, wherein a plurality of nozzles are arranged in an aligned direction in the recording head; a mounting section on which the recording head is mounted; a fixing member to apply an elastic force so as to fix the recording head on the mounting section; and an inclination adjusting member to push a side of the recoding head located along the aligned direction of the nozzles against the elastic force of the fixing member so as to displace the side of the recording head so that the inclination adjusting member adjusts an inclination of the aligned direction of the nozzles for the main scanning direction.

6 Claims, 1 Drawing Sheet

ADJUSTING APPARATUS FOR ADJUSTING INCLINATION OF RECORDING HEAD OF INKJET PRINTER

BACKGROUND OF THE INVENTION

The present invention relates to an adjusting apparatus for adjusting the inclination of a recording head of an inkjet printer.

An inkjet printer that records an image by jetting an ink particle at a predetermined timing from a nozzle of a recording head onto a recording medium requires to accurately adjust the relative position between the recording head and the recording medium so that an image of high accuracy and quality is recorded. Especially, it is important that a number of nozzles formed on the nozzle surface of the recording head are arranged in alignment in a direction orthogonal to the scan direction of the recording head. If the alignment direction of the nozzles has an inclination with respect to a normal direction even a little, impact positions by ink particles get deviated, resulting in extreme degradation in image quality.

Therefore, conventionally, as disclosed in the Patent Document 1 described below, a recording head is urged by a press member against the reference face of a carriage having the recording head mounted thereon, thereby defining the position of the recording head on the carriage.

[Patent Document 1] TOKKOHEI No. 5-48194

However, the above method that defines the position of a recording head by urging it against a reference face requires high accuracy in all parts related to manufacturing a recording head, manufacturing a carriage, and driving a carriage, which is a problem of exceedingly high cost.

Further, although a carriage is desired to be lightweight in order to achieve miniaturization of the carriage itself and a driving motor for driving the carriage, the requirement for high accuracy in positioning has resulted in causing a problem of increase in size and weight of the carriage.

SUMMARY OF THE INVENTION

To overcome the abovementioned drawbacks, an object of the present invention is, as described below, to provide an adjusting apparatus for adjusting the inclination of a recording head of an inkjet printer, wherein the adjusting apparatus with a simple construction can adjust the inclination of the recording head with high accuracy.

The above problems can be solved by the following structure, according to the invention.

There is provided an ink-jet printer for forming an image in a main scanning direction for each line. The ink-jet printer comprises: a recording head to form an image, wherein a plurality of nozzles are arranged in an aligned direction in the recording head; a mounting section on which the recording head is mounted; a fixing member to apply an elastic force so as to fix the recording head on the mounting section; and an inclination adjusting member to push a side of the recoding head located along the aligned direction of the nozzles against the elastic force of the fixing member so as to displace the side of the recording head so that the inclination adjusting member adjusts an inclination of the aligned direction of the nozzles for the main scanning direction.

Further, the problems can also be solved by the following preferable structures.

In a first aspect, there is provided an adjusting apparatus for adjusting the inclination of a recording head of an inkjet printer which comprises a fitting section for fitting a recording head having a plurality of nozzles arranged in alignment, and a press member for pressing a side face of the recording head, the side face being parallel to the direction of the alignment of the nozzles. The adjusting apparatus for adjusting the inclination of the recording head of the inkjet printer presses the side face of the recording head with the above press member, and thereby making it possible to adjust the inclination of the alignment direction of the nozzles of the recording head at the fitting section, wherein the press member comprises a rod that linearly moves in the direction parallel to the alignment of the nozzles, and the adjusting apparatus presses the side face of the recording head by the rod.

In a second aspect, the adjusting apparatus for adjusting the inclination of a recording head of an ink-jet printer is provided, the apparatus according to the first aspect, wherein the fitting section is provided with a guide surface that gradually slopes toward the above mentioned side face of the recording head; the tip of a rod moves toward the side face of the recording head along the guide surface when the rod tip linearly moves as described above; and thereby the rod tip presses the side face of the recording head.

In a third aspect, the adjusting apparatus for adjusting the inclination of a recording head of an inkjet printer is provided, the apparatus according to the first aspect, wherein the rod tip is formed in a tapered shape, the diameter of the tip gradually tapering near the end, and thus a surface on the tip side of the rod presses the side face of the recording head.

In a fourth aspect, the adjusting apparatus for adjusting the inclination of a recording head of an inkjet printer is provided, the apparatus according to the first, second, or third aspect, wherein the rod linearly moves by being rotated with the use of a thread structure of a thread section formed on the rod.

According to the invention, a simple structure which only presses a side face of a recording head by a rod, of a press member, that linearly moves in the direction parallel to the alignment of nozzles makes it possible to accurately adjust the inclination of the recording head without the necessity of raising the accuracy of parts, which conventionally has been done, and to avoid the possibility of a great increase in the weight of a carriage.

DETAILED DESCRIPTION OF THE PREFERRED EMBODIMENTS

Figure 1:
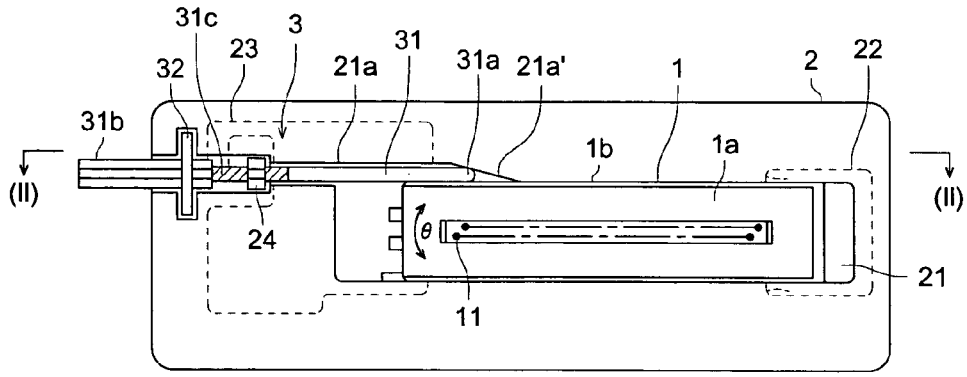
FIG. 1 is a diagram showing a fitting section, viewed from the bottom side, of a carriage provided with an adjusting apparatus, according to the invention, for adjusting the inclination of a recording head.

Referring to the drawings, embodiments of the present invention will be described below.

Figure 2:
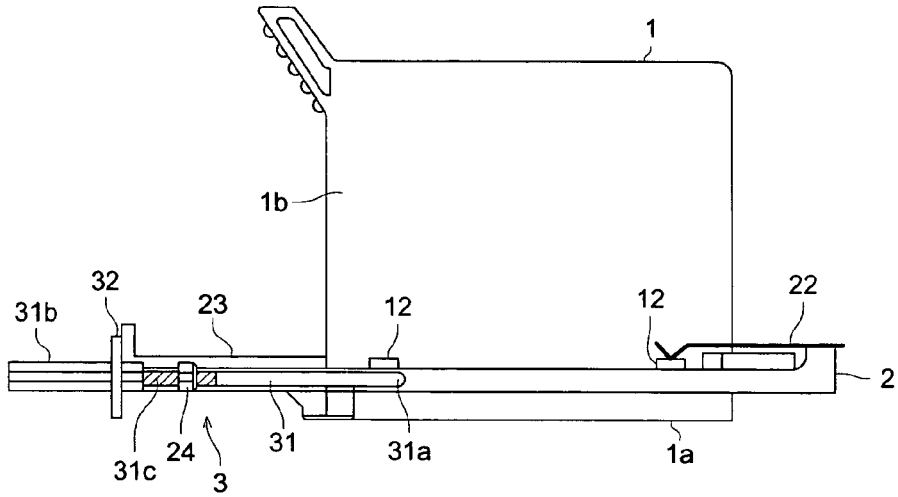
FIG. 2 is a sectional view of the above fitting section taken along line (II)—(II) in FIG. 1.

FIG. 1 is a diagram showing a fitting section of a carriage provided with an adjusting apparatus, of the invention, for adjusting the inclination of a recording head, viewed from the bottom side (ink jetting side of the recording head), and FIG. 2 is a sectional view of the fitting section taken along line (II)—(II) in FIG. 1.

In the figures, numeral 1 denotes a recording head of which bottom face is arranged to be ink jetting surface 1*a* through which a number of nozzles 11 are arranged in a direction from the left to the right in the figure. Numeral 2 denotes a fitting section of the carriage having the recording head 1 mounted thereon. Opening 21 is formed through the fitting section 2. Through the opening 21, the ink jetting face 1*a* of the recording head 1 is inserted. Stop protrusions 12 protrusively formed sideward from side faces of the recording head 1 are contacted with the inner peripheral edge of the opening 21, and thus the position of the recording head 1 is defined at the fitting section 2. Numeral 22 denotes sandwiching-fixing pieces for fixing the stop protrusions 12 of the recording head 1 by sandwiching it with the inner peripheral edge of the opening 21.

Numeral 3 denotes a press member that is a component of the adjusting apparatus, of the invention, for adjusting the inclination of the recording head. The press member 3 comprises cylindrical rod 31 extending in the direction (direction from the left to the right, in the figure) parallel to the alignment of the nozzles 11 of the recording head 1, wherein the rod 31 is housed in rod housing section 21*a* formed by the opening 21 of the fitting section 2.

The rod housing section 21*a* extends from one end section (the left end section, in the figure) of the opening 21 to one section (the left end section, in the figure) of the fitting section 2, wherein, in the rod housing section 21*a*, front end 31*a* of the rod 31 reaches one side face 1*b* of the recording head 1, while rear end 31*b* projects from the one end (the left end, in the figure) of the fitting section 2, and the rod 31 is rotatively supported by support plate 32 provided on one end side (left end side, in the figure) of the fitting section 2. Numeral 23 denotes a sandwiching-fixing fitting for covering the top face of the rod housing section 21*a* and fixing one end section of the recording head 1 by sandwiching it with the inner peripheral edge of the fitting section 2.

The rod 31 is provided with bolt section 31*c* in the middle section thereof, and is screw-engaged to nut 24 fixed in the rod housing section 21*a* of the fitting section 2. Therefore, by clockwise rotating the rear end 31*b* of the rod 31, the rod 31 linearly moves inside the rod housing section 21*a* in the direction parallel to the alignment of the nozzles 11 of the recording head 1, on the one side face 1*b* of the recording head 1, and to the right in the figure. By counterclockwise rotating the rear end 31*b* of the rod 31, the rod 31 linearly moves inside the rod housing section 21*a* in the direction parallel to the alignment of the nozzles 11 of the recording head 1, on the one side face 1*b* of the recording head 1, and to the left in the figure.

The portion of the rod housing section 21*a*, the tip 31*a* of the rod 31 being housed in the portion, is formed as guide surface 21'*a* having a gradual slope toward the one side face 1*b* of the recording head 1, wherein when the rear end 31*b* of the rod 31 is clockwise rotated and thus the rod 31 is linearly moved parallel to the direction of the alignment of the nozzles 11 of the recording head 1 to the right in the figure, the tip 31*a* of the rod 31 moves, with the linear motion thereof, along the guide surface 21*a*' toward the one side face 1*b* of the recording head 1. Thus, the tip 31*a* of the rod 31 is guided by the guide surface 21*a*', and thereby the tip 31*a* of the rod 31 gradually presses the one side face 1*b* of the recording head 1. By properly adjusting the movement amount of the rod 31, that is, properly adjusting the rotation amount of the rear end 31*b* of the rod 31, the inclination θ of the alignment direction of the nozzles 11 of the recording head 1 can be adjusted.

Figure 3:
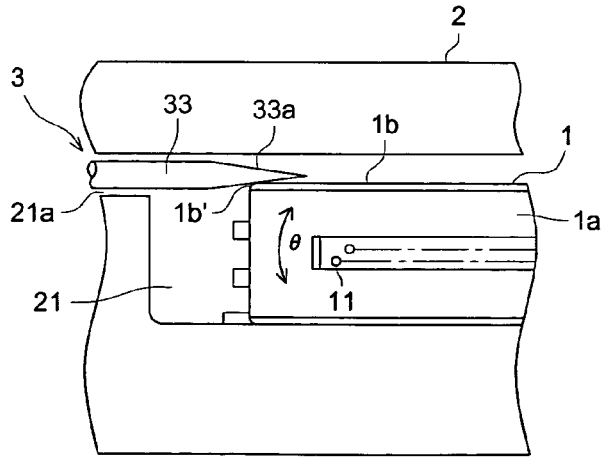
FIG. 3 is a diagram showing a fitting section, viewed from the bottom side, of a carriage, wherein the fitting section is provided with a press member in another embodiment.

FIG. 3 shows a press member in another embodiment. The same elements with those in FIG. 1 are given with the same reference numerals, and herein, only an essential part having a difference from FIG. 1 is shown.

Rod housing section 21*a*, shown in the figure, is not formed with guide surface 21*a*' as shown in FIG. 1, and tip 33*a* of rod 33 is movable between the inner surface of opening 21 and one side face 1*b* of recording head 1 in the direction from the left to the right in FIG. 3.

In this embodiment, press member 3 has the rod 33, housed in rod housing section 21*a* of the opening 21 of fitting section 2, wherein the tip 33*a* of the rod 33 is formed in a tapered shape, the diameter of the tip 33*a* gradually tapering near the end, and the tip 33*a* of the tapered shape is in contact with one end section 1*b*' of the one side face 1*b* of recording head 1.

Therefore, when the rear end of the rod 33 is clockwise rotated and thus the rod 33 is linearly moved parallel to the direction of the alignment of the nozzles 11 of the recording head 1 to the right in the figure, the tip 33*a* of the rod 33, with the linear motion thereof, presses the one end section 1*b*' of the one side face 1*b* of the recording head 1 with the taper gradually thinning near the end, and moves the recording head 1 such that the gap between the one side 1*b* of the recording head 1 and the peripheral edge on the same side of the opening 21 gradually becomes wider. Thus, by properly adjusting the movement amount of the rod 33, that is, properly adjusting the rotation amount of the rear end of the rod 33, the inclination θ of the alignment direction of the nozzles 11 of the recording head 1 can be adjusted likewise as above.

In this way, according to the present invention, by a mere structure of which the press member 3 having the rod 31 or 33 that linearly moves parallel to the alignment direction of the nozzles 11 presses the side face 1*b* of the recording head 1, the inclination of the recording head 1 can be adjusted. Thus, an extremely simple structure achieves an inclination adjusting apparatus which is lightweight and compact-sized.

Further, since especially high accuracy of parts is not required, it is possible to reduce the cost.

Still further, according to the degree of the slope of the guide surface 21*a*' or the degree of taper of the tip 33*a* of the rod 33, the pressing amount of the recording head 1 at the time of the linear motion of the rod 31 or 33 can be freely determined, and also according to the slope of the guide surface 21*a*' or the taper of the tip 33*a* of the rod 33, adjustment of inclination in an extremely micro scale is allowed.

Particularly as shown in the respective embodiments, the rod 31 or 33 is linearly moved by being rotated by the screw-engaging structure of the bolt section 31*c* formed on the rod 31 or 33, and thus the linear movement amount of the rod 31 or 33 is determined by the rotation amount thereof, allowing micro adjustment with easiness.

What is claimed is:

1. An ink-jet printer for forming an image in a main scanning direction for each line, comprising:

a recording head to form an image, wherein a plurality of nozzles are arranged in an aligned direction in the recording head;

a mounting section on which the recording head is mounted;

a fixing member to apply an elastic force so as to fix the recording head on the mounting section; and an inclination adjusting device having a moving member movable along a side of the recording head, the side being located along the aligned direction of the nozzles, to push the side against the elastic force of the fixing member so as to displace the side of the recording head so that the inclination adjusting device adjusts an inclination of the aligned direction of the nozzles with respect to the main scanning direction;

wherein the moving member pushes the side, along a direction different from a direction of motion of the moving member.

2. The ink-jet printer of claim 1, wherein the mounting section includes a guide surface slanted gradually along the side of the recording head and the moving member is adapted to move along the guide surface so as to push the side of the recording head.

3. The ink-jet printer of claim 1, wherein the moving member is tapered in such a way that a tip end of the moving member is smaller than a middle portion of the moving member and the moving member is adapted to move so as to push the side of the recording head with the tapered portion of the moving member.

4. The ink-jet printer of claim 3, wherein the moving member pushes the side of the recording head with the tapered portion of the moving member at one end of the side.

5. The ink-jet printer of claim 1, wherein the inclination adjusting device includes a screw mechanism so that when the moving member is rotated, the moving member is moved along the side of the recoding head.

6. An inclination adjusting device for use in an ink-jet printer for forming an image in a main scanning direction for each line, wherein the ink-jet printer is provided with a recording head to form an image in which a plurality of nozzles are arranged in an aligned direction in the recording head; a mounting section on which the recording head is mounted; and a fixing member to apply an elastic force so as to fix the recording head on the mounting section; the inclination adjusting device comprising:

a moving member movable along a side of the recording head, the side being located along the aligned direction of the nozzles, to push side against the elastic force of the fixing member so as to displace the side of the recording head so that the inclination adjusting device adjusts an inclination of the aligned direction of the nozzles with respect to the main scanning direction wherein the moving member pushes the side along a direction different from a direction of motion of the moving member.

* * * * *